United States Patent [19]

Enda et al.

[11] Patent Number: 4,663,085

[45] Date of Patent: May 5, 1987

[54] APPARATUS FOR DECONTAMINATION OF RADIATION CONTAMINATED METALLIC WASTE

[75] Inventors: Masami Enda, Yokohama; Reiko Fujita, Kamakura; Tetsuo Morisue, Yokohama; Yutaka Hasegawa, Kawasaki, all of Japan

[73] Assignee: Kabushiki Kaisha Toshiba, Kawasaki, Japan

[21] Appl. No.: 710,178

[22] Filed: Mar. 11, 1985

[30] Foreign Application Priority Data

| | | | |
|---|---|---|---|
| May 25, 1984 | [JP] | Japan | 59-106083 |
| May 25, 1984 | [JP] | Japan | 59-106084 |
| May 25, 1984 | [JP] | Japan | 59-106085 |
| Sep. 26, 1984 | [JP] | Japan | 59-201181 |

[51] Int. Cl.[4] ..... G21F 9/00; G21F 9/28

[52] U.S. Cl. ..... 252/626; 134/3; 134/13; 134/104; 204/1.5; 204/149; 204/152; 204/194; 204/232; 204/234; 204/235; 204/237; 204/238; 204/240; 204/267; 376/313; 376/314

[58] Field of Search ..... 252/626, 631, 80, 86, 252/87; 204/1.5, 149, 152, 130, 194, 228, 232, 237, 238, 240, 267, 250, 253; 376/310–315; 422/159, 903

[56] References Cited

U.S. PATENT DOCUMENTS

| | | | |
|---|---|---|---|
| 4,162,229 | 7/1979 | Loewenchuss | 252/626 |
| 4,217,192 | 8/1980 | Lerch et al. | 204/149 |

FOREIGN PATENT DOCUMENTS

| | | | |
|---|---|---|---|
| 0030068 | 6/1981 | European Pat. Off. | 252/626 |
| 0134664 | 3/1985 | European Pat. Off. | 252/626 |
| 0003598 | 1/1985 | Japan | 252/626 |
| 1604371 | 12/1981 | United Kingdom | 252/626 |

OTHER PUBLICATIONS

Partridge, et al. 1979, Chemical Decontamination of Metals, Transactions of the American Nuclear Society 33, pp. 430–431.

Partridge, et al. 1979, Decontamination of TRU Contaminated Metals HEDL-TC-1503, 14 pages.

*Primary Examiner*—Stephen J. Lechert, Jr.
*Assistant Examiner*—Howard J. Locker
*Attorney, Agent, or Firm*—Finnegan, Henderson, Farabow, Garrett & Dunner

[57] ABSTRACT

The invention resides in an apparatus for the decontamination of radioactivated metallic waste by the electrolytic oxidation-reduction with an aqueous nitric acid solution containing trivalent cerium ions, i.e. the step of converting the trivalent cerium ions into tetravalent cerium ions through electrolytic oxidation and the step of dissolving the surface layer of the radioactivated metallic waste by oxidizing it with the electrolytic solution now vested with the oxidative power of the freshly produced tetravalent cerium ions and, at the same time, effecting regeneration of the tetravalent cerium ions. The main objects of this invention are to provide a high decontamination efficiency and suppression of the amount of secondary waste to be generated to the minimum by the apparatus which is capable of thoroughly dissolving the surface layer of the object under treatment without reference to size and shapes, the very factors that prevent the conventional methods of decontamination from fulfilling their functions indiscriminately, thereby lowering the level of radioactivity to a point where the object will be handled as safely as ordinary industrial waste.

13 Claims, 13 Drawing Figures

APPARATUS FOR DECONTAMINATION OF RADIATION CONTAMINATED METALLIC WASTE

BACKGROUND OF THE INVENTION

This invention relates to an apparatus for the decontamination of radioactive metallic waste generated as in a nuclear power plant and required to be decontaminated for safe disposal.

Generally, radioactive metallic waste generated as in a nuclear power plant is put to permanent storage within the plant's premises and thereby prevented from producing adverse effects upon the environment.

When this practice of permanent storage is continued, however, the total amount of storage of such radioactive metallic waste will increase, eventually making it difficult to find a space for further storage. Pipes and other similar objects which are contaminated by radioactivity in the nuclear power plant have large dimensions and cannot be readily reduced in size by any of the existing treatments. These objects, therefore, are put in storage only with difficulty.

Studies are now under way in search of a method which is capable of decontaminating such radioactive metallic waste and lowering its level of radioactivity to the level of radioactivity existing in nature, namely the background level of radioactivity, and thereby enabling the metallic waste to be handled as safely as ordinary industrial waste.

The radioactive metallic waste, however, has contaminants adhered to its surface. Mere removal of contaminants loosely piled up on the surface hardly suffices for ample decontamination. Sufficient decontamination necessitates dissolution of surface layers of metallic matrices which are covered with adhered deposited contaminants.

Prior art methods of decontaminating such radioactive metallic waste include, a method of electrolytic decontamination which accomplishes the decontamination by electrochemically dissolving the surface layers of the metallic matrices and a method of chemical decontamination which chemically dissolves the surface layers of metallic matrices by use of a decontaminating agent.

The method of electrolytic decontamination is advantageous in that it effects decontamination at a high speed. It nevertheless entails the disadvantage that it cannot be applied effectively to metallic matrices of complicated shape because it requires the surface of the electrode to be opposed to the surface of the metallic matrix under treatment.

The method of chemical decontamination enjoys high adaptability to metallic matrices of complicate shape. It has the disadvantage, however, that the decontamination proceeds at a slow speed and the decontaminating agent is irreversibly consumed and consequently gives rise to a large volume of spent decontaminating agent which constitutes secondary waste.

Moreover, the decontaminating agents used in the apparatus for chemical decontamination and the apparatus for electrolytic decontamination are destined to be completely exhausted because of deterioration of performance and accumulation of radioactivity and inevitably give birth to secondary waste in large volumes.

U.S. Pat. No. 4,217,192, for example, discloses a method and system for the decontamination of metallic objects radioactively contaminated in the nuclear industry by means of chemical etching.

This chemical etching resorts to the effects of oxidation and reduction obtained by a procedure which comprises immersing, in an electrolytic solution formed of a nitric acid solution containing trivalent cerium ions and tetravalent cerium ions and held in one container, a given contaminated metallic object in conjunction with a pair of electrodes intended for regeneration of the electrolytic solution, allowing the metallic object to stand therein until it is relieved of radioactivity, and removing the decontaminated metallic object from the electrolytic solutiuon.

Since this method is operated batchwise and not continuously, it has the disadvantage that the operation itself entails extra time and labor each time one round of operation is replaced by the next one and the period of exposure of operators to radiation is long. Since this method uses a concentrated nitric acid solution at elevated temperatures, it has the possibility that the solution will emit nitric acid gas and nitric acid mist and impair the working environment. Further, this method has the disadvantage that the residue of etching produced within the electrolytic solution will be suspended in the form of slurry to hasten wear of the electrolytic solution, deprive the electrolytic solution of its function, and even shorten its service life.

In the disclosure, no measure for overcoming these disadvantages is not suggested at all.

OBJECT OF THE INVENTION

The first object of this invention is to provide an apparatus for the decontamination of radioactive metallic waste as the object of treatment, which is capable of thoroughly dissolving the surface layer of the object under treatment without reference to size and shape, the very factors that prevent the conventional methods of decontamination from fulfilling their functions indiscriminately, thereby lowering the level of radioactivity to a point where the object will be handled as safely as ordinary industrial waste.

The second object of this invention is to provide an apparatus for the decontamination of radioactive metallic waste, which is capable of regenerating the decontaminating agent used in the form of electrolytic solution thereby minimizing the occurrence of secondary waste.

The third object of the invention is to provide an apparatus for the decontamination of radioactive metallic waste, which effects decontamination at a high speed, curbs the occurrence of spent electrolytic solution by ensuring reclamation thereof, and warrants safe attendance of operators.

The fourth object of the present invention is to provide an apparatus for the decontamination of radioactive metallic waste which is capable of efficiently curbing the occurrence of radioactive secondary waste in the disposal of used electrolytic solution having dissolved therein metallic ions contaminated by radioactivity.

SUMMARY OF THE INVENTION

The first aspect of the present invention resides in an apparatus for the decontamination of radioactive metallic waste by the electrolytic oxidation-reduction with an aqueous nitric acid solution containing trivalent cerium ions, i.e. the step of converting the trivalent cerium ions into tetravalent cerium ions through electrolytic oxidation and the step of dissolving the radioactive metallic waste with the electrolytic solution now vested with the oxidative power of the freshly produced tetravalent cerium ions and, at the same time, effecting regeneration of the tetravalent cerium ions, which apparatus is characterized by a device disposed inside an electrolytic cell and adapted to stir the electrolytic solution therein, a filter adjoined to the electrolytic cell and adapted to screen oxides such as of iron, and a condenser, a demister, and a waste gas blower all adapted to recover the mixed vapor and mist of water and nitric acid ($H_2O$—$HNO_3$).

A second aspect of this invention resides in an apparatus for the decontamination of radioactive metallic waste, characterized by disposing an electrolytic cell for holding the electrolytic solution of cerium nitrate ($Ce^{3+}$—$Ce^{4+}$—$HNO_3$) and a decontamination cell for decontaminating the radioactive metallic waste independently of each other and interposing a filter between the electrolytic cell and the decontamination cell.

A third aspect of the present invention resides in an apparatus for the decontamination of radioactive metallic waste, characterized by having a waste gas treating device for recovery of nitric acid vapor communicate with the decontamination cell and the electrolytic cell in the apparatus of the second aspect of the invention. In the decontamination cell, the pipe for feeding the electrolytic cell is shaped in the form of a nozzle so constructed that the electrolytic solution will be discharged in a sprayed form from the tip thereof.

A fourth aspect of this invention resides in an apparatus for the decontamination of radioactive metallic waste, comprising the aforementioned electrolytic cell, a decontamination cell for dissolving the surface layer of the object under treatment thereby effecting the decontamination of the object, an overflow tube disposed on the lateral wall of the electrolytic cell, an overflow tube disposed on the lateral wall of the decontamination cell, a decontamination drain tube disposed on the bottom side of the decontamination cell, a drain tank communicating with the two overflow tubes and the decontamination drain tube and serving to admit the electrolytic solution overflowing from the electrolytic cell, the electrolytic solution overflowing from the decontamination cell, and the electrolytic solution drained from the decontamination cell, an electrolytic solution transfer tube for returning the electrolytic solution from the drain tank to the electrolytic cell, a decontaminant transfer tube for returning the electrolytic solution from the drain tank to the decontamination cell, a waste gas duct disposed in the space overlying the electrolytic cell, the decontamination cell, and the drain tank, a nitric acid vapor recovery device connected to the waste gas duct, a waste gas treating device consisting of a mist recovery device and a gas exhauster, a flush water tube for delivering rinse water from a rinse water tank to the decontamination cell, and a rinse return tube for returning the rinse water used in the decontamination cell from the decontamination cell to the aforementioned rinse water tank.

A fifth aspect of this invention resides in an apparatus for the decontamination of radioactive metallic waste, characterized by immersing in the electrolytic cell having dissolved therein metallic ions including radioactivated metallic ions an anode made of an inactive metal and a cathode made of a metallic material possessing hydrogen overvoltage of a larger absolute value than the absolute value of the hydrogen overvoltage of iron. This aspect of the invention is further characterized by causing flow of direct current between the anode and the cathode, causing the metallic ions including radioactive metallic ions in the electrolytic solution to be precipitated and deposited on the cathode, then separating the deposited precipitate from the cathode, and discarding the separated deposit as radioactive waste.

DESCRIPTION OF PREFERRED EMBODIMENTS

Figure 1:
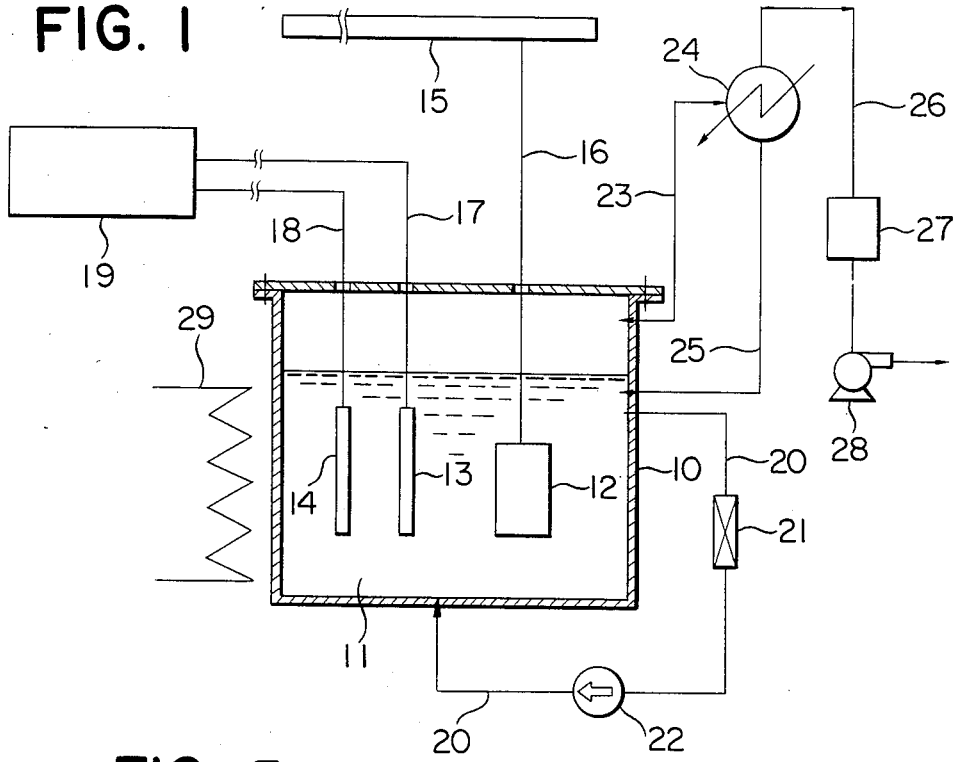
FIG. 1 is a longitudinal cross section illustrating, schematically in part, the first embodiment of the present invention.

An apparatus for the decontamination of radioactivated metallic waste as in the first embodiment of this invention will be described below with reference to FIG. 1. In FIG. 1, an electrolytic cell 10 contains therein an electrolytic solution 11 which is a cerium nitrate solution containing trivalent cerium ions and tetravalent cerium ions ($Ce^{3+}$—$Ce^{4+}$—$HNO_3$). In the electrolytic solution 11 are immersed an object 12 for decontamination, namely radioactive metallic waste, an anode 13, and a cathode 14. The object 12 for decontamination is connected to a cable 16 hung down from a stationary mechanism 15 disposed above the electrolytic cell 10. The anode 13 and the cathode 14 are connected respectively with electric wires 17, 18 to a DC power source 19. A pipe 20 communicating at one end thereof with the lateral side of the electrolytic cell 10 and at the other end with the bottom side thereof is laid through a filter 21 and a circulation pump 22. By the circulation pump 22, the electrolytic solution 11 in the electrolytic cell 10 is drawn out of the lateral side of the electrolytic cell 10, passed through the filter 21, and returned to the electrolytic cell 10 through the bottom side thereof. Oweing to the flow of the electrolytic solution through the circulation pipe 20, the electrolytic solution 11 inside the electrolytic cell 10 is kept stirred.

To the upper lateral side of the electrolytic cell 10 is connected a waste gas pipe 23. The water-nitric acid vapor ($H_2O$—$HNO_3$) and the mist emanating from the electrolytic solution 11 are forwarded through the waste gas pipe 23, condensed in a condensor 24, sent through a return pipe 25 connecting the condensor 24 to the electrolytic cell 10, and recovered in the electrolytic cell 10. The portion of the water-nitric acid ($H_2O$—$HNO_3$) vapor and the mist which has escaped being so recovered is advanced through a gas flow pipe 26 connected to the outlet of the condensor 24, sent through a demister 27, and then drawn by a waste gas blower 28 and recovered in the demister 27. A heater 29 is disposed on the lateral side of the electrolytic cell 10. This heater 29 serves to keep the electrolytic solution 11 at a stated temperature.

In the apparatus of this invention for the decontamination of radioactive metallic waste constructed as described above, the preparation for start of the operation is made by placing in the electrolytic cell 10 the electrolytic solution 11 obtained by dissolving a prescribed amount of cerium nitrate ($Ce(NO_3)_3$) in a water-nitric acid ($H_2O$—$HNO_3$) solution (in proportions such as to give a $Ce(NO_3)_3$ concentration of 0.8 mol/liter and a $HNO_3$ concentration of 2.0 mols/liter, for example) and starting the circulation pump 22 rotating thereby causing circulation of the electrolytic solution 11 from the lateral side of the electrolytic cell 10, through the pipe 20, to the bottom side of the electrolytic cell 10. The heater 29 is used to elevate the temperature of the electrolytic solution 11 to the prescribed level (70° to 90° C., for example) and the waste gas blower 28 is used to keep the inner atomosphere of the electrolytic cell 10 under negative pressure. Then, the direct current power source 19 is used to apply voltage between the anode 13 and the cathode 14, causing the flow of electric current at a density of 0.1 to 0.2 A/cm$^2$. Consequently, there ensues reactions of the following formulas, involving conversion of trivalent cerium ions ($Ce^{3+}$) into tetravalent cerium ions ($Ce^{4+}$).

At anode 13:

$$Ce^{3+} \rightarrow Ce^{4+} + e- \quad (1)$$

$$2OH- \rightarrow H_2O + (\tfrac{1}{2})O_2(\uparrow) + 2e- \quad (2)$$

At cathode 14:

$$H^+ + e- \rightarrow (\tfrac{1}{2})H_2(\uparrow) \quad (3)$$

The reaction forming $Ce^{4+}$ on the anode 13 depends on the speed at which the $Ce^{3+}$ ions are dispersed and allowed to reach the surface of the anode 13. When the electrolytic solution 11 is allowed to flow into the electrolytic cell through the bottom thereof, the electrolytic solution held inside the electrolytic cell 10 is stirred by the incoming electrolytic solution so as to promote the reaction forming the $Ce^{4+}$.

After the $Ce^{4+}$ concentration of the electrolytic solution has reached a prescribed level (0.4 mol/liter, for example), the object 12 for decontamination is connected to the cable hung down from the stationary mechanism 15 and is then lowered and immersed in the electrolytic solution 11 ($Ce^{3+}$—$Ce^{4+}$—$HNO_3$ solution). As a result, a reaction of the following formula (4) occurs on the surface of the object 12 and radioactive waste deposited on the surface of the object 12 under decontamination and the surface of the metal (M) constituting the matrix of the object 12 are dissolved out by the reaction and the radioactive material is removed from the object 12.

$$M + Ce^{4+} \rightarrow M^+ + Ce^{3+} \quad (4)$$

The reaction of the formula (4) depends on the speed at which the $Ce^{4+}$ is dispersed and consequently allowed to reach the surface of the metal (M). Thus, the stirring of the electrolytic solution 11 is effective in promoting the reaction of dissolution. After the immersion has continued for a prescribed period (for 60 minutes, for example), the object 12 being discontaminated is denuded of the radioactive material and of the contaminant layer deposited on the inner surface. The level of radioactivity of the object is consequently lowered to the so-called background level, allowing the object to be handled as safely as ordinary industrial waste.

Figure 2:
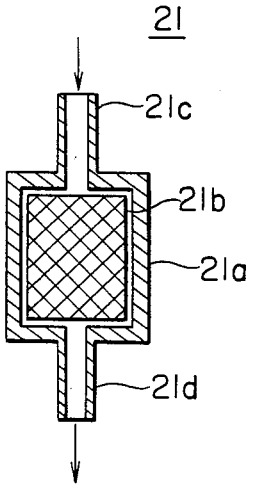
FIG. 2 is a longitudinal cross section schematically illustrating a filter used in the apparatus of FIG. 1.

In the meantime, the $Ce^{3+}$ which has been reduced by the reaction with the object 12 undergoes the reaction of the formula (1) and gives rise to $Ce^{4+}$ because the DC power source 29 keeps applying the voltage (4 to 6 V, for example) between the electrodes and keeps the flow of electric current at a stated density. Further, oxides such as of iron which are suspended in the electrolytic solution 11 are recovered by the filter 21 disposed in the pipe 20, so that possible adhesion of the oxides to the anode can be prevented and the formation of $Ce^{4+}$ is allowed to proceed efficiently. The filter 21, for example, may be a product of Brunswick Corp., which has a filter element **21*b* filling a filter housing 21*a* and an inlet pipe 21*c* and an outlet pipe 21*d* connected to a pipe 20 as illustrated in FIG. 2. The oxides in the electrolytic solution are removed by being adsorbed on the filter element 21*b*. The circulation pump 22** may be a magnet pump made by Iwaki Co., Ltd. and marketed under trademark designation of MDH-F.

Figure 3:
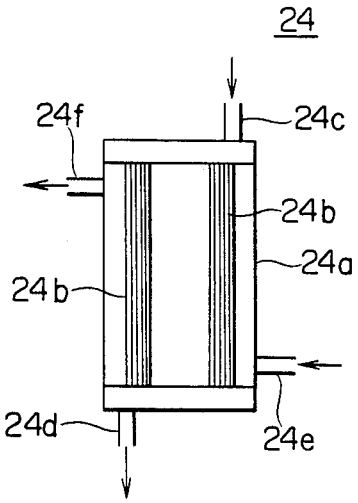
FIG. 3 is a front view schematically illustrating a condenser used in the apparatus of FIG. 1.
Figure 4:
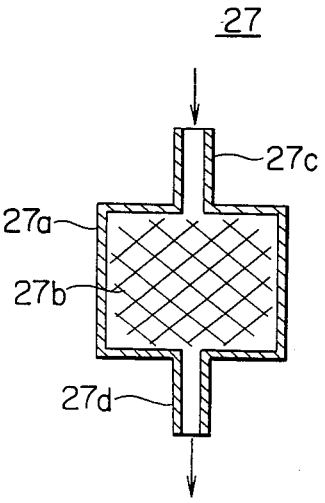
FIG. 4 is a longitudinal cross section schematically illustrating a demister used in the apparatus of FIG. 1.

The water-nitric acid ($H_2O$—$HNO_3$) vapor and mist emanating from the electrolytic solution 11 are forwarded through the waste gas pipe 23 connected to the upper section of the electrolytic cell 10. The condenser 24 has 18 stainless steel tubes **24*b* in a cylindrical housing 24*a* as illustrated in FIG. 3. The tubes 24 are cooled with cooling water outside their shells. The water-nitric acid ($H_2O$—$HNO_3$) vapor enters the housing 24*a* through the gas inlet 24*c*, passes through the interiors of the tubes 24*b*, and discharges from the condensate outlet 24*d*. The cooling water enters the housing 24*a* through the cooling water inlet 24*e*, passes over the outer faces of the tubes 24*b* to cool the tubes, and discharged through the cooling water outlet 24*f*. The portion of the water-nitric acid ($H_2O$—$HNO_3$) vapor which is condensed by the condensor 24 is sent through the return pipe 25 and recovered in the electrolytic cell 10. The portion of the water-nitric acid ($H_2O$—$HNO_3$) vapor and mist which has escaped being so recovered is drawn by the waste gas blower 28 and recovered by the demister 27. The demister 27 has glass fibers 27*b* filling a housing 27*a* as illustrated in FIG. 4. The water-nitric acid ($H_2O$—$HNO_3$) vapor and mist enter the housing through the inlet pipe 27*c* and are removed by being deposited on the glass fibers 27*b*. The clean gas is released through the outlet pipe 27*d*. The blower 28** may be an air pump made by Iwaki Co., Ltd. and marketed under trademark designation of AP-DS.

The second embodiment wherein the electrolytic cell for electrolyzing the electrolytic solution ($Ce^{3+}$—$Ce^{4+}$—$HNO_3$ solution) and the decontamination cell for decontaminating the radioactivated metallic waste are disposed independently of each other will be described with reference to FIG. 5.

Figure 5:
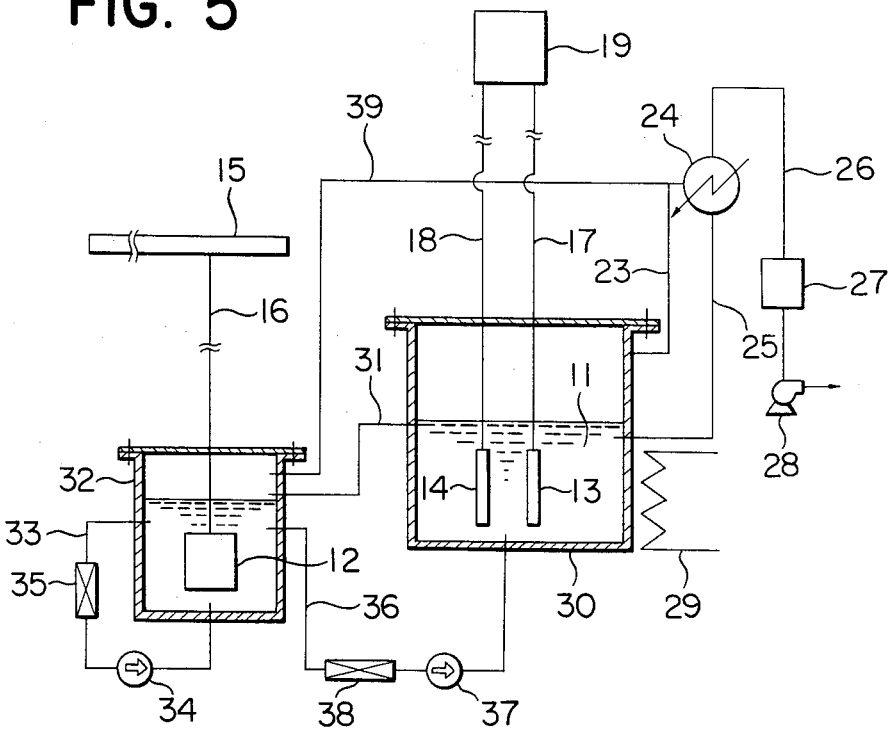
FIG. 5 is a longitudinal cross section illustrating, schematically in part, the second embodiment of this invention.

In FIG. 5, the symbol 30 denotes an electrolytic cell substantially equal to the electrolytic cell described in the first embodiment above. Inside the electrolytic cell 30, the electrolytic solution ($Ce^{3+}$—$Ce^{4+}$—$HNO_3$ solution) 11 is contained. In the electrolytic solution 11 are immersed the anode 13 and the cathode 14. The anode 13 and the cathode 14 are connected respectively through the electric wires 17, 18 to the DC power source 19. To the electrolytic cell 30 is connected an overflow line 31. The electrolytic solution 11 is fed through this overflow line 31 to a decontamination cell 32. Inside the decontamination cell 32, the object 12 for decontamination is immersed. This object 12 is tied to the cable 16 hung down from the stationary mechanism 15 disposed above the decontamination tank 32. To the decontamination cell 32 is connected a circulation pipe 33 adapted to stir the electrolytic solution 11. By a circulation pump 34, the electrolytic solution 11 is forwarded through a filter 35 and introduced into the decontamination cell 32 through the bottom side thereof. A return pipe 36 is laid to communicate at one end with the decontamination cell 32 and at the other end with the electrolytic cell 30 and a feed pump 37 passes the electrolytic solution 11 of the electrolytic cell 32 through a filter 38 and introduces it into the electrolytic cell 30 through the bottom side thereof.

Waste gas pipes 23, 39 are connected respective to the upper sections of the electrolytic cell and the decontamination cell 32. The water-nitric acid ($H_2O$—$HNO_3$) vapor and mist emanating from the electrolytic solution 11 are passed through the waste gas pipes 23, 39 and treated by the condenser 24, the demister 27, and the waste gas blower 28. The symbol 29 denotes a heater for the electrolytic solution.

In the apparatus of this embodiment of this invention, the decontamination is effected by placing the electrolytic solution 11 obtained by dissolving a prescribed amount of cerium nitrate ($Ce(NO_3)_3$) in a water-nitric acid ($H_2O$—$HNO_3$) solution both in the electrolytic cell 30 and the decontamination cell 32, actuating the circulation pump 37 to forward the prepared electrolytic solution from the side of the electrolytic cell 30, through the overflow line 31, into the decontamination cell 32. The heater 29 is used to keep the temperature of the electrolytic solution 11 at a prescribed level. The waste air blower 28 is used to keep the inner atmosphere of the electrolytic cell 30 and that of the decontamination cell 32 under negative pressure. At the same time, the DC power source 19 is used to apply voltage between the anode 13 and the cathode 14 and keep the flow of electric current of a prescribed density therebetween. Consequently, within the electrolytic solution 11, the reactions of the formulas (1), (2), and (3) described with respect to the apparatus of FIG. 1 proceed with formation of $Ce^{4+}$.

Since the electrolytic solution 11 is caused to flow into the electrolytic cell 30 through the bottom side thereof similarly to the setup of FIG. 1, the electrolytic solution 11 in the electrolytic cell 30 is stirred to promote the reaction for the foration of $Ce^{4+}$ efficiently. After the $Ce^{4+}$ concentration of the electrolytic solution 11 has reached a prescribed level, the object 12 is connected to the cable 16 hung down from the stationary mechanism 15 disposed above the decontamination cell 32 and then lowered and immersed in the electrolytic solution 11 within the decontamination cell 32. At the same time, the circulation pump 34 is operated to forward the electrolytic solution 11 through the stirring pipe 33 and introduce it into the decontamination cell 32 through the bottom side thereof.

With this apparatus, the reaction of formula (4) described above with reference to the apparatus of FIG. 1 occurs on the surface of the object 12 and causes dissolution of the radioactive material and the surface of metal matrix and removal of the contaminant. Since the electrolytic solution is caused to flow into the decontamination cell 32 through the bottom side thereof to stir the electrolytic held inside the decontamination cell 32 similarly to the setup of FIG. 1, the reaction for the dissolution is promoted. After the immersion of the object in the electrolytic solution has continued for a prescribed period, the object 12 is denuded of the radioactive material and the deposit on the inner surface of the object and the level of radioactivity is lowered to the socalled background level. Thus, the object can be handled as safely as any industrial waste.

Since the DC power source 19 continues application of voltage and flow of electric current of a prescribed density between the anode and the cathode, the $Ce^{3+}$ which has been reduced by the reaction with the object 12 undergoes the reaction of the formula (1) described with reference to the setup of FIG. 1 and consequently causes regeneration of $Ce^{4+}$. Moreover, since the oxides such as iron suspended in the electrolytic solution 11 inside the decontamination cell 32 are recovered by the filters 35, 38 disposed in the stirring pipe 32 and the return pipe 36, possible adhesion of the oxides to the anode 13 within the electrolytic cell 30 can be prevented, enabling the formation of $Ce^{4+}$ to proceed with high efficiency. In the meantime, the water-nitric acid ($H_2O$—$HNO_3$) vapor and mist emanating from the electrolytic solution 11 within the electrolytic cell 30 and the decontamination cell 32 are forwarded through the waste gas pipes 23, 39 connected to the upper sections of the electrolytic cell 30 and the decontamination cell 32 and subjected to the same treatment as involved in the embodiment of FIG. 1.

The anode 13 is preferably made of a material such as, for example, platinum or titanium which exhibits resistance to corrosion by such strongly acidic substances as $HNO_3$ and $Ce^{4+}$ and avoids undergoing abrasion on electrolysis. The cathode 14 is preferably made of a material such as, for example, gold. For the stirring of the electrolytic solution, a stirrer or other similar device may be used. As the source of heat for warming the electrolytic solution, not only an external heater but also an imbedded heater can be used.

An experiment was performed for the purpose of confirming the effect of the embodiment described above. The results of the experiment will be described below with reference to FIG. 6 and FIG. 7.

Figure 6:
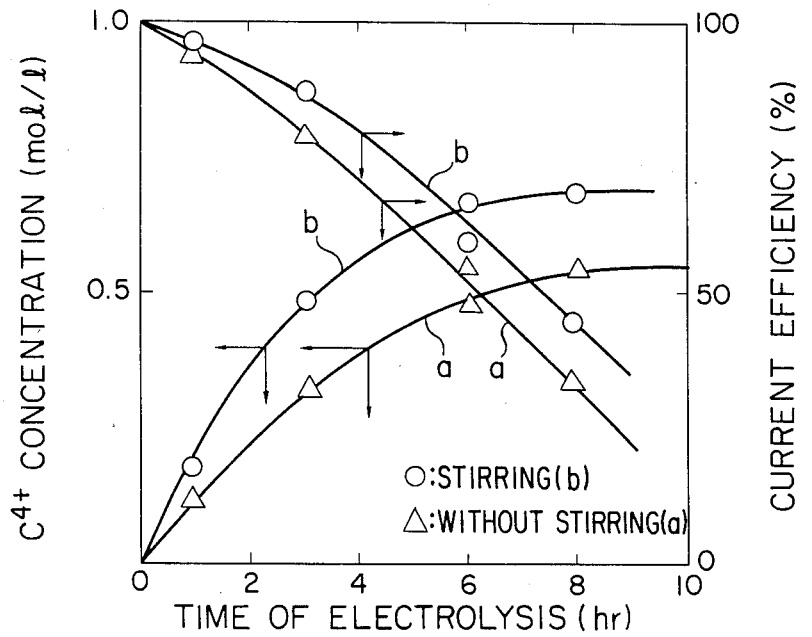
FIG. 6 is a characteristic diagram showing the relation between the time of electrolysis and the concentration of $Ce^{4+}$ as obtained by the apparatus of this invention and the conventional apparatus.

In FIG. 6, the line a represents a data of the electrolysis performed without stirring and the line b the data of the electrolysis performed under stirring. The vertical axis represents the scale of the $Ce^{4+}$ concentration in the electrolytic solution and the current efficiency, and the horizontal axis the scale of the time of electrolysis. The electrolysis was carried out on an electrolytic solution having a $Ce(NO_3)_3$ concentration of 0.8 mol/liter and a $HNO_3$ concentration of 2 mol/liter under the conditions of 80° C. of electrolytic solution temperature and 0.3 A/cm$^2$ of electric current density to form $Ce^{4+}$. The amount of $Ce^{4+}$ formed was determined by analysing the sample of potentiometric titration and the current efficiency was determined as follows:

$$\eta = (96485 \times Ce^{4+} \text{ amount of formed (in mol/liter)} \times \text{amount of electrolytic solution (liter)}/(\text{Time of electrolysis (in sec)} \times \text{electric current (A)})$$

It is noted from FIG. 6 that the formation and regeneration of $Ce^{4+}$ can be attained with high efficiency by carrying out the electrolysis while keeping the electrolytic solution stirred.

Now, FIG. 7 will be described. In due consideration of the results of FIG. 6, an electrolysis solution having a $Ce^{4+}$ concentration of 0.4 mol/liter and a $HNO_3$ concentration of 2 mol/liter was heated to 80° C. and a radiation contaminated metal object (AISI 304, 2B sch 40×165 inches) was immersed in the hot solution and, at the same time, an electric current was passed at a density of 0.3 A/cm$^2$ to effect regeneration of $Ce^{4+}$. In the diagram, the curve c represents the data of the immersion of the object without stirring of the electrolytic solution, the curved the data of the immersion under stirring of the electrolytic solution, and the horizontal line the background. The vertical axis of the graph represents the scale of the intensity of the gamma ($\gamma$) radiation (in cpm) and the horizontal axis the scale of the time of decontamination.

Figure 7:
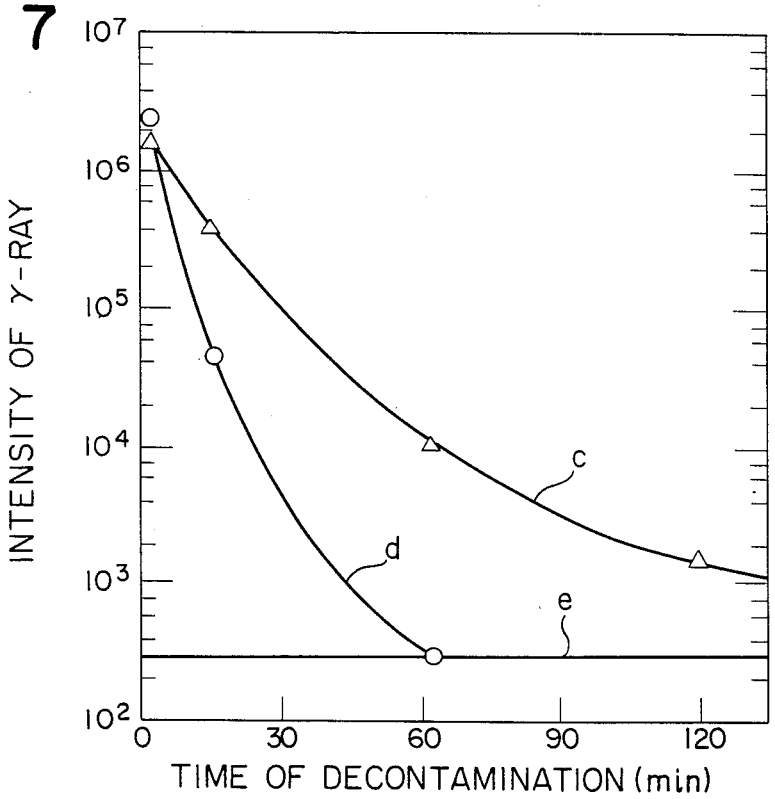
FIG. 7 is a characteristic diagram showing the relation between the time of decontamination and the reduction in the degree of surface contamination as obtained by the apparatus of this invention and the conventional apparatus.

It is noted from FIG. 7 that the contamination on the surface can be lowered to the background level in 60 minutes of decontamination when the object metal is immersed in the stirred electrolytic solution and that the contamination of the surface cannot be lowered to the background level even in 120 minutes of decontamination when the object metal is immersed in the unstirred electrolytic solution.

Since the oxides, such as iron suspended in the electrolytic solution are recovered by the filter, the otherwise possible adhesion of such oxides to the anode can be prevented. Thus, the regeneration of $Ce^{4+}$ can be effected with added efficiency.

By disposing the electrolytic cell and the decontamination cell independently of each other, the possible damage to the electrodes resulting from a collision with the object metal can be precluded. Since this setup permits easy insertion and removal of the object metal, it permits ease of maintenance and inspection.

Now, the third embodiment of this invention will be described below with reference to FIG. 8 through FIG. 11.

Figure 8:
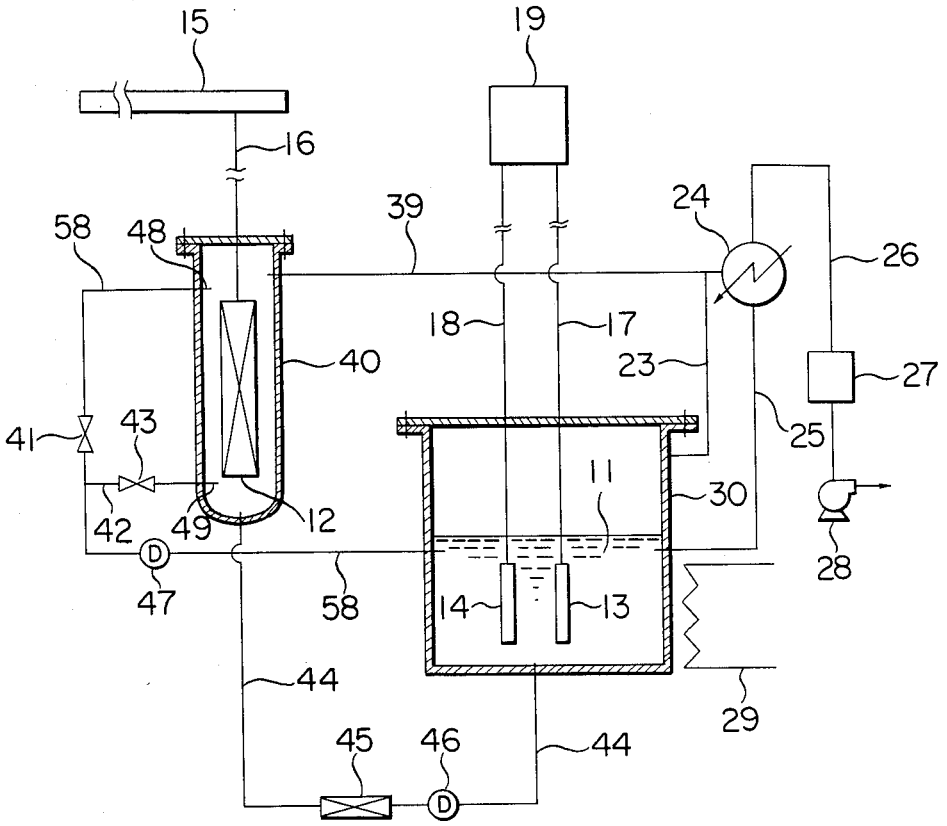
FIG. 8 is a system diagram illustrating an apparatus for decontamination as the third embodiment of the present invention.

In FIG. 8, the symbol 30 denotes the electrolytic cell. The electrolytic cell 30 contains therein a $Ce^{3+}$-$Ce^{4+}$-$HNO_3$ solution as the electrolytic solution 11. In the electrolytic solution 11 are immersed the anode 13 and the cathode 14. The anode 13 and the cathode 14 are connected respectively through the electrode wires 17, 18 to the DC power source 19. To the electrolytic cell 30 is connected a liquid feed pipe 58. The electrolytic solution 11 is supplied through the liquid feed pipe 58 to a decontamination cell 40. In the decontamination cell 40 is immersed the object 12 for decontamination. The object 12 is connected to the cable 16 hung down from the stationary mechanism 15 disposed above the decontamination cell 40. In order that the electrolytic solution 11 may be supplied downwardly and upwardly into the decontamination cell 40 via the upper and lower sections thereof, the liquid feed pipe 58 is provided with a first valve 41 and a branched pipe 42 is disposed on the downstream side of the first valve 41 and this branched pipe 42 is extended through a second valve 43 and connected to the lower lateral side of the decontamination cell 40. By these valves 41, 43, the electrolytic solution 11 to be supplied to the decontamination cell can be switched between the upward and downward directions. To the bottom of the decontamination cell 40 is connected a drain line 44. The contaminated liquid resulting from the treatment of the object 12 is discharged from the decontamination cell 40, advanced through this drain line 44, passed through a filter 45 and a circulation pump 46, and introduced into the electrolytic cell 30 through the lower side thereof.

The liquid feed pipe 58 is provided with a liquid pump 47.

To the upper lateral side of the electrolytic cell 30 is connected a waste gas pipe 23. Similarly to the upper lateral side of the decontamination sell 40 is connected a waste gas pipe 39. The nitric acid vapor and mist emanating from the electrolytic cell 30 and the decontamination cell 40 are forwarded through the waste gas pipes 23, 39, condensed by the condensor 24, and passed through the return pipe 25 to be recovered inside the electrolytic cell 30. The portion of the nitric acid vapor and mist which have escaped being so recovered as drawn by the waste gas blower 28 and recovered by the demister 27. The symbol 29 denotes a heater disposed on the lateral side of the electrolytic cell 30 and adapted to heat the electrolytic solution 11.

In the apparatus of the present invention constructed as described above for the decontamination of radioactive metallic waste, the electrolytic solution 11 obtained by dissolving a prescribed amount (0.4 mol/liter, for example) of $Ce(NO_3)_3$ in a nitric acid solution (2.0 mol/liter, for example) is placed in the electrolytic cell 30 and subjected to electrolysis by applying voltage of 4 to 6 V between the anode 13 and the cathode 14 by the direct power source 19, the circulation pump 47 is operated to forward the prepared electrolytic solution 11 through the pipe 58, and the valves 41, 43 are opened to spray the electrolytic solution 11 into the decontamination cell 40 through the upper and lower sections thereof, where it is then allowed to flow down the inner wall of the object. Through the drain line 44, the electrolytic solution is circulated between the electrolytic cell 30 and the decontamination cell 40.

The electrolytic solution 11 is heated by the heater 29 to a prescribed temperature (to 70° to 90° C., for example). The waste gas blower 28 is used to keep the inner atmosphere of the electrolytic cell 30 and that of the decontamination cell 40 under negative pressure (several mmHg, for example). At the same time, the DC power source is used to apply voltage (4 to 6 V, for example) between the anode 13 and the cathode 14 and a flow of electric current of a prescribed density (0.1 to 0.2 A/cm$^2$, for example) therebetween.

Inside the electrolytic solution 11, the reactions of the formulas (1) through (3) mentioned above occur with formation of $Ce^{4+}$.

After the $Ce^{4+}$ concentration in the electrolytic solution has reached a prescribed level, the object is fastened to the cable 16 hung down from the stationary mechanism 15 and the electrolytic solution ($Ce^{3+}$—$Ce^{4+}$—$HNO_3$ solution) in the decontamination cell 40 is sprayed through nozzles 48, 49 disposed at the leading ends of the connection pipes 36 and the branched pipe 42. In this case, the reaction of the formula (4) mentioned above occurs on the surface of the object 12 to effect dissolution of the radioactive material and other similar deposits on the surface of the object and removal of contamination.

After the object 12 has been sprayed with the electrolytic solution 11 for a prescribed period, the object is denuded of radioactive material adhering to the surface and the contaminated layer adhering to the inner surface. As result, the radioactivity of the object 12 is lowered to the so-called background level. Thus, it can be handled as safely as any industrial waste.

Since the DC power source 19 continues to apply voltage and keep the flow of electric current at a prescribed density between the anode and the cathode, the $Ce^{3+}$ in the contaminated liquid which has been reduced by the reaction with the object 12 undergoes the reaction of the formula (1) mentioned above with formation of $Ce^{4+}$ and regeneration of the electrolytic solution. During the course of the reaction, the drain suspended in the electrolytic solution 11 and the oxide such as of iron in the contaminated layer are recovered by the filter 45 of a construction similar to the construction shown in FIG. 1 disposed in the drain line 44. As the result, possible adhesion of the oxide of iron to the anode 13 of the electrolytic cell 30 is precluded, the formation of $Ce^{4+}$ proceeds with high efficiency, and the regeneration of the electrolytic solution ensues advantageously.

The nitric acid vapor and mist emanating from the electrolytic cell 30 and the decontamination cell 40 are forwarded through the waste gas pipe 23, 39 connected to the upper sections of the electrolytic cell 30 and the decontamination cell 40, condensed by the condensor 24 of a construction similar to the construction shown in FIG. 1, and recovered via the return pipe 25 into the electrolytic cell 30. The portion of the vapor and mist which have escaped being so recovered are drawn by the waste gas blower 28 and recovered by the demister 27 of a construction similar to the construction shown in FIG. 1.

The electrodes are made of a material such as platinum or titanium which exhibits resistance to corrosion by strong acidic substances such as $HNO_3$ and $Ce^{4+}$ and avoids abrasion on electrolysis.

As means of stirring the electrolytic solution, a stirrer or other similar device may be used. As the source of heat for warming the electrolytic solution, not only an external heater but also an imbedded heater can be used.

Figure 9:
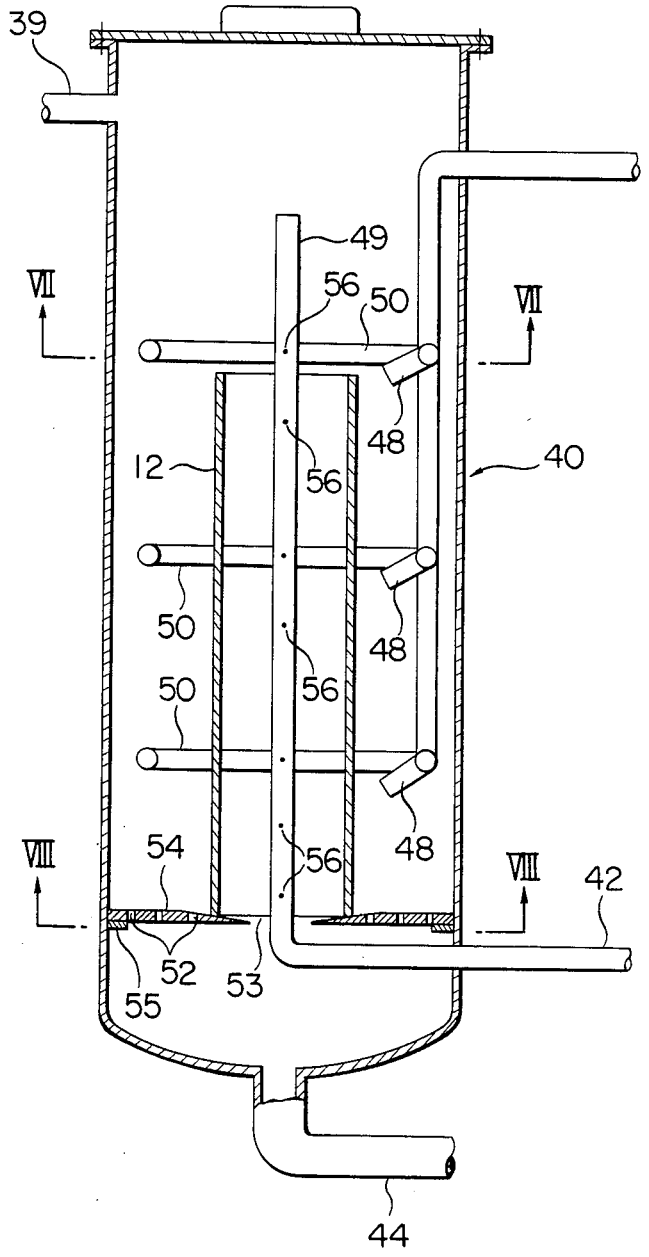
FIG. 9 is a longitudinal cross section illustrating the decontamination cell of the apparatus of FIG. 8 as magnified.
Figure 10:
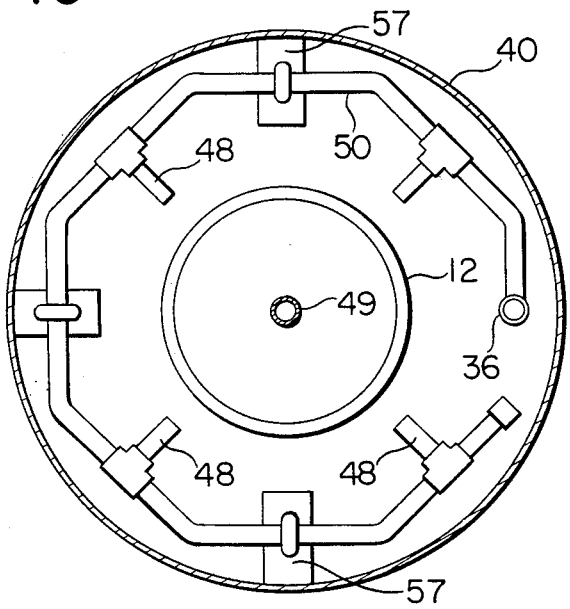
FIG. 10 is a cross section taken along the line VII—VII in the diagram of FIG. 9.

FIG. 9 illustrates the decontamination cell 40 of the apparatus of FIG. 8 in a magnified state. FIG. 10 is a cross section taken along the line VII—VII in the diagram of FIG. 9.

In FIG. 9 and FIG. 10, the symbol 40 denotes the decontamination cell. This decontamination cell 40 is provided therein with annular pipes 50 connected stepwise to a connecting tube 36, a plurality of slanted nozzles 48 connected to the pipes 50, and a straight vertical nozzle 49 connected to a branching pipe 42 and perforated with discharge orifices 56. In the lower section inside the decontamination cell 40, a perforated plate 54 containing a multiplicity of holes 52 and a central through hole 53 is disposed through the medium of a supporting piece 55. The object 12 for decontamination is mounted on this perforated plate 54. In FIG. 9, the object 12 is shown as a cylindrical pipe. The electrolytic solution is supplied through the connection pipe 36 into the decontamination cell 40 and thrown out onto the outer side of the object 12 through the slanted nozzles 48 attached to the annular pipes 50 disposed stepwise. The electrolytic solution is also thrown out onto the inner side of the object 12 through the vertical nozzle 49 provided on the lateral side thereof with a multiplicity of holes 56 to effect decontamination on the inner side of the object 12. The annular pipes 50 are secured with the supporting member 57 to the inner wall of the decontamination cell 40.

Figure 11:
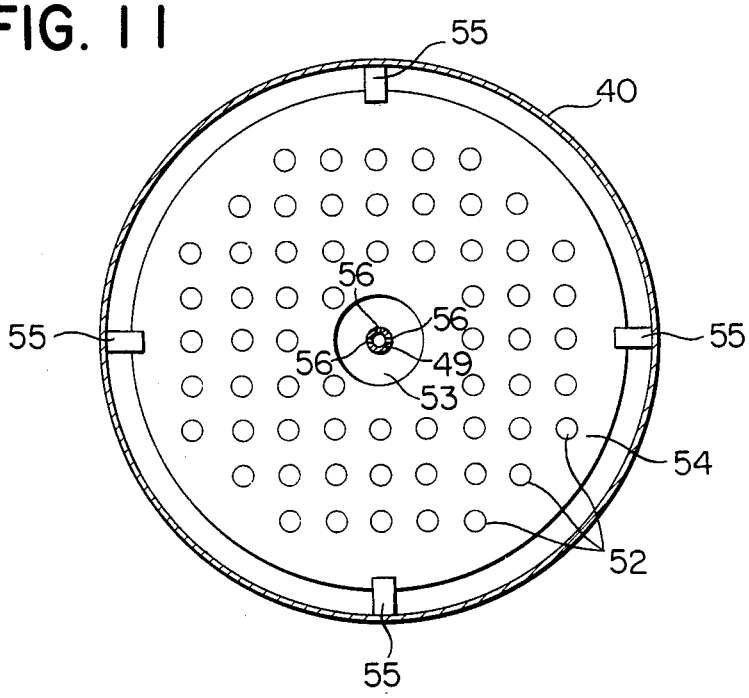
FIG. 11 is a cross section taken along the line VIII—VIII in the diagram of FIG. 10.

FIG. 11 is a cross section taken along the line VIII—VIII in the diagram of FIG. 9.

In FIG. 11, the electrolytic solution is passed through the vertical nozzle 49 and thrown out toward the inner side of the object 12 held inside the decontamination cell 40. The electrolytic solution, after discharging its part on the inner side of the object, flows down the object, passes through the through hole 53 in the perforated plate 54, and runs into the drain line 44 to be recovered therein.

In this third embodiment of the invention, the electrolytic solution ($Ce^{3+}$—$Ce^{4+}$—$HNO_3$ solution) is supplied through the connection pipe 36 and the branched pipe 42 into the decontamination cell 40 and then thrown out of the nozzles 48 and the pipe 49 onto the object 12. The electrolytic solution impinging on the object 12 flows down the object, passes through the holes 52 and the through hole 53 in the perforated plate 54 and collects in the drain line 44 to be recovered therefrom. The connecting pipe 58 is provided with valves 41, 42 by means of which it is allowed to effect selective decontamination on the inner side and/or the outer side of the object 12. FIG. 9 illustrates a pipe for use in the atomic pile as one example of the object 12 for decontamination. The portion of the nitric acid vapor and mist which escapes being recovered are advanced through the waste gas pipe 39 and treated and recovered by the condenser 24 and the demister 27.

Now, a concrete use of the apparatus illustrated in FIG. 8 will be described below.

Inside the decontamination cell 40, a pipe (2B sch. 40×165 inches) made of stainless steel (AISI 304) was suspended. The electrolytic solution used in this case had a $Ce^{4+}$ concentration of 0.4 mol/liter. The work of decontamination was performed for a varying length of time. The results were as shown in Table 1.

The table shows the results of decontamination at a fixed temperature of 80° C. It is noted from the table that no effective decontamination was observed for the period of 30 minutes, effective decontamination to the background level was observed for the period of 90 minutes, and effective decontamination to even below the background level was observed for the period of 120 minutes. The thickness of abrasion represents the amount of decontamination calculated for the loss of weight and the intensity of $\alpha$-ray represents the amount of surface contamination of the object.

TABLE 1

Decontamination of pipe of stainless steel

| Time of decontamination (min.) | Difference of weight (g) | Thickness of abrasion ($\mu$) | Intensity of $\alpha$-ray (cpm) |
|---|---|---|---|
| 0 | 0 | 0 | 624,000 |
| 30 | 9,241 | 31 | 4,450 |

TABLE 1-continued

| Decontamination of pipe of stainless steel | | | |
|---|---|---|---|
| Time of decontamination (min.) | Difference of weight (g) | Thickness of abrasion (μ) | Intensity of α-ray (cpm) |
| 60 | 13,845 | 47 | 485 |
| 90 | 17,213 | 58 | 237 |
| 120 | 19,823 | 67 | 169 |

note;
(1) The data represent the results obtained by using 10.3 liters of the decontamination liquid.
(2) Background level, 250 cpm.

In the third embodiment described above, the surface of the radioactive metallic waste is dissolved by the oxidative power of the tetravalent cerium ions and the regeneration of tetravalent cerium ions is effected by electrolysis. In the apparatus for the decontamination for the radioactive metallic waste, the electrolytic cell and the decontamination cell are disposed independently of each other and the decontamination cell is provided therein with pipes containing holes and spray nozzles disposed in a plurality of steps, so that the electrolytic solution is sprayed onto the object within the decontamination cell.

In the third embodiment, therefore, the consumption of the electrolytic solution can be lowered by enabling this solution to be sprayed and then recovered for subsequent use. Further, this apparatus permits selective decontamination of only the inner side or only the outer side of the object. It also permits minimization of the amount of the decontamination liquid to be used and enables the level of the radioactivity of the object to be lowered to the background level. The object so decontaminated can then be handled as safely as any industrial waste.

Now, the fourth embodiment of the present invention will be described with reference to FIG. 12.

Figure 12:
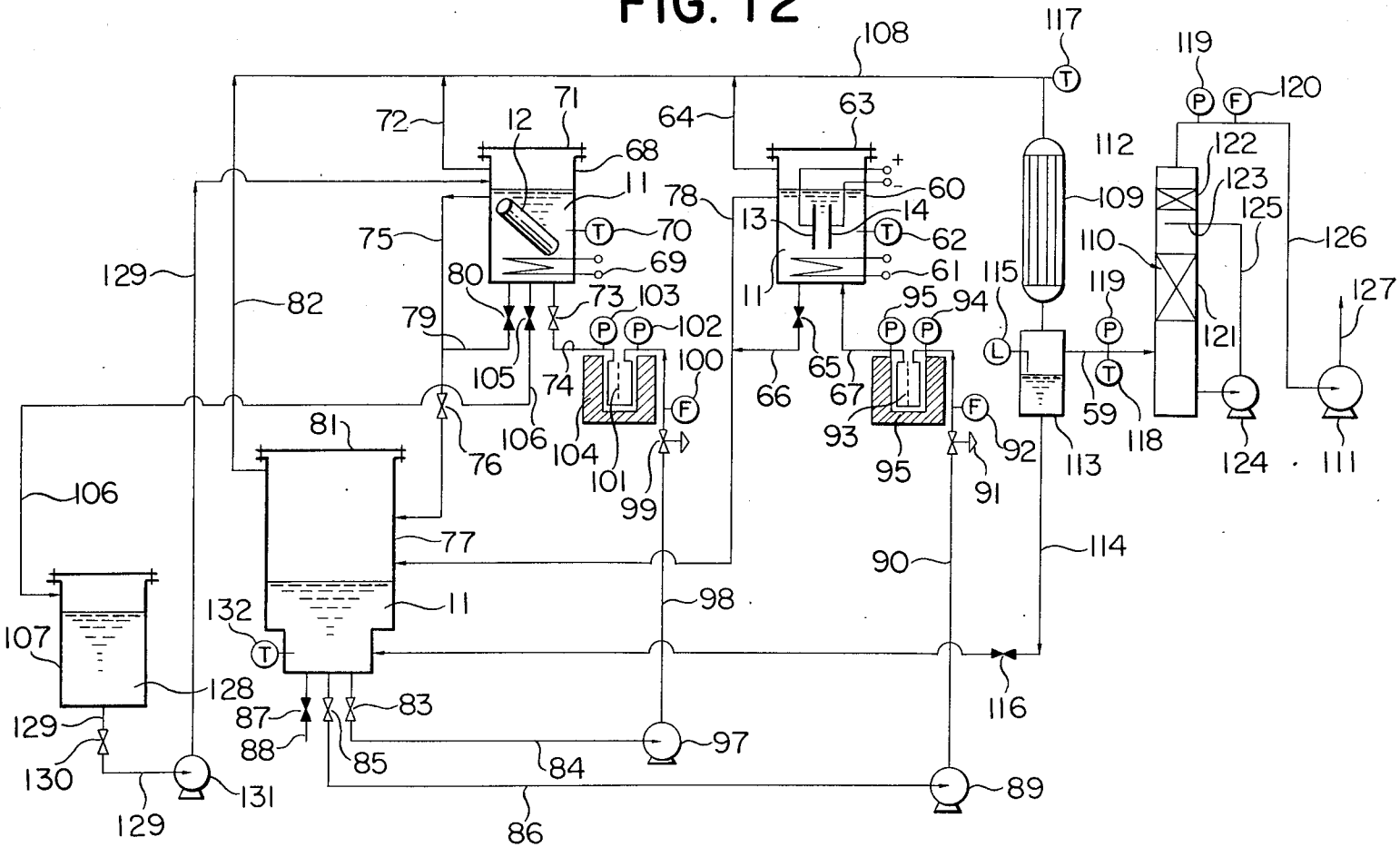
FIG. 12 is a system diagram illustrating the fourth embodiment of the present invention.

In FIG. 12, the symbol 60 denotes the electrolytic cell. Inside this electrolytic cell 60 is contained the electrolytic solution 11 formed of an aqueous nitric acid solution containing trivalent cerium ions and tetravalent cerium ions. In this electrolytic solution 11 are immersed the anode 13 and the cathode 14 which function to form tetravalent cerium ions from trivalent cerium ions through the electrolytic oxidation-reduction reaction. The aforementioned electrolytic cell 60 is provided therein a heater 61 for heating the electrolytic solution 11 and a temperature sensor 62 for detecting and controlling the temperature of the electrolytic solution 11. Further this electrolytic cell 60 is airtightly covered with a lid 63. To the upper lateral side of the electrolytic cell 60 is connected a waste gas pipe 64. To the lower side of the electrolytic cell 60 are connected a drain pipe 66 incorporating a valve 65 and a liquid feed pipe 67.

The decontamination cell 68 is disposed separately of the aforementioned electrolytic cell 60. This decontamination cell 68 contains therein the electrolytic solution 11 formed of an aqueous nitric acid solution containing trivalent cerium ions and tetravalent cerium ions similarly to the aforementioned electrolytic cell 60. In this electrolytic solution 11 is immersed the object for decontamination. Inside the decontamination cell 68, the surface layer of the metallic matrix constituting the object 12 is dissolved by the oxidative power which is generated when the tetravalent cerium ions are converted into trivalent cerium ions and, thus, the surface of the object 12 is relieved of contamination. The contamination cell 68 is provided therein with a heater 69 for heating the electrolytic solution 11 and a temperature sensor 70 for detecting and controlling the temperature of the electrolytic solution 11. This decontamination cell 68 is airtightly covered with a lid 71. To the upper lateral side of the decontamination cell 68 is connected a waste gas pipe 72. A liquid feed pipe 74 incorporating a valve 73 is connected to the lower side thereof.

An overflow pipe 75 is connected to the lateral side of the decontamination cell 68. To the downstream side of the overflow pipe 75 is connected a drain tank 77 through the medium of a valve 76. This drain tank 77 collects the electrolytic solution 11 flowing in through the drain pipe 66 and the overflow pipe 78 both connected to the lower section end of the aforementioned electrolytic cell 60, the overflow pipe 75 of the decontamination cell 68, and a drain pipe 79 provided with a valve 80. The drain tank 77 is airtightly covered with a lid. To the upper lateral side of this drain tank 77 is connected a waste gas pipe 82.

To the lower side of the drain tank 77 are further connected a first pipe 84 incorporating a valve 83, a second pipe 86 incorporating a valve 85, and a third pipe 88 incorporating a valve 87.

On the lateral wall of the aforementioned electrolytic cell 60, the overflow pipe 78 is disposed as described above. The other end of this overflow pipe 78 is extended through the valve 76 and connected to the aforementioned drain tank 77. Conversely, from the drain tank 77 toward the aforementioned electrolytic cell 60, a liquid feed pipe 90 is extended from the second pipe 86 through the medium of the pump 89 and made to communicate with the liquid feed pipe 67. Between the liquid feed pipe 90 and the liquid feed pipe 67, there is disposed a pump 89 for forwarding the electrolytic solution from the aforementioned drain pipe 77 through the second pipe 86 to the aforementioned electrolytic cell 60, a flow volume regulating valve 90 for controlling the flow volume of the electrolytic solution 11, and a flow meter 92 for monitoring the flow volume of the electrolitic solution 11. Midway in the length of the liquid feed pipe 90 is disposed a filter for depriving the electrolytic solution 11 of insolubles. A pressure gauge 94 is disposed on the upstream side of the filter 93 and a pressure gauge 95 on the downstream side thereof to permit continued watch on the aforementioned filter 93 for clogging. This filter is enclosed with a shielding member 96 (made of a lead plate 100 mm in thickness, for example).

On the lateral wall of the aforementioned decontamination cell 68, the overflow pipe 75 incorporating the valve 76 is disposed. The other end of the overflow pipe 75 is made to communicate with the aforementioned drain tank 77. Conversely, from the drain tank 77 toward the aforementioned decontamination cell 68, a liquid feed pipe 98 is extended through the first pipe 84 and the pump 97 and made to communicate with the liquid feed pipe 74. Between the liquid feed pipe 98 and the liquid feed pipe 74 are disposed a pump 97 for forwarding the electrolytic solution 11 from the aforementioned drain tank 77 to the aforementioned decontamination cell 68, a flow volume regulating valve 99 for controlling the flow volume of the electrolytic solution, and a flowmeter 100 for monitoring the flow volume of the electrolytic solution. In the liquid feed pipe 98 for the decontamination cell is disposed a filter 101 adapted to deprive the electrolytic solution 11 of insolubles. A pressure gauge 102 is disposed on the upstream side of the filter 101 and a pressure gauge 103 on the downstream side thereof to permit continued watch on the aforementioned the filter 101 for clogging. This filter 101 is covered with a shielding member 104. The aforementioned decontamination cell 68 is provided on the bottom side thereof with a drain pipe 79 and a rinse water return pipe 106 incorporating a valve 105. The drain pipe 79 is connected to the aforementioned drain tank 77 through the medium of the valve 80 and the return pipe 106 is made to communicate with a rinse water tank 107.

The upper spaces of the aforementioned decontamination cell 68, the aforementioned electrolytic cell 60, and the aforementioned drain tank 77 communicate respectively through the waste gas pipes 64, 72, and 82 with a gas duct 108. This waste gas duct 108 is connected through a nitric acid vapor recovery device 109, a receptacle 113, and the waste gas pipe 59 to a mist recovery device 110. This mist recovery device 110 is connected through the waste gas pipe to a waste air blower 111. The term "waste gas treating device" 112 embraces the nitric acid vapor recovery device 109 and the waste gas blower 111. Below the aforementioned nitric acid vapor recovery device 109 is disposed a receptacle 113. This receptacle 113 and the aforementioned drain tank 77 are connected to each other through the medium of a recovered liquid return pipe 114. The aforementioned receptacle is provided with a level gauge 115 adapted to keep watch on the amount of the recovered liquid. Halfway in the length of the aforementioned recovered liquid return pipe 114 is disposed a valve 116. When the level gauge 115 senses accumulation of the recovered liquid in the aforementioned receptacle 113 above a certain level, the excess of the recovered liquid is returned to the aforementioned drain tank 77. The aforementioned waste gas duct 108 is provided with a concentration sensor 117 adapted to keep watch on the waste gas concentration. The aforementioned waste gas treating device 113 is provided at all proper places with temperature sensors 118 for watching waste gas temperature, pressure gauges 119 for watching pressure of waste gas, and flowmeters 120 for watching flow volume of waste gas. The mist recovery device 110 is provided therein with a first filter 121, a second filter 122, and a spray nozzle 123. The spray nozzle 123 is connected to a feedback pipe 125 for spray. A pump 124 advances the waste gas through the feedback pipe 125 and blows it in the form of spray through the spray nozzle 123, with the result that the waste gas is circulated within the mist recovery device 110. The waste gas which flows out of the mist recovery device 110 is advanced through the waste gas pipe 126 and the waste gas blower 111 and released through a discharge pipe 127 into the ambient air.

The aforementioned rinse water tank 107 stores rinse water 128. The rinse water tank 107 and the aforementioned decontamination cell 68 are connected to each other through the medium of a rise water feed pipe 129. Halfway in the length of the rinse water feed pipe 129 are disposed a valve 130 and a pump 131 which enable the rinse water 128 to be transferred from the rinse water tank 107 to the decontamination cell 68. The bottom side of the aforementioned decontamination cell 68 and the aforementioned rinse water tank 107 are connected to each other through the medium of the rinse water return pipe 106. Midway in the length of the rinse water return pipe 106 is disposed a valve 105. The rinse water used in the aforementioned decontamination cell 68, therefore, can be returned from the decontamination cell 68 to the rinse water tank 107 when necessary.

The drain tank 77 is provided with a thermometer 132 adapted to measure the temperature of the electrolytic solution 11.

Now, the method for using the fourth embodiment of the invention for the decontamination of a radioactive metallic waste and the function of the apparatus will be described below.

By the operation of the pump 89, the electrolytic solution 11 (containing 0.8 mol of $Ce(NO_3)_3$ and 2.0 mol of $HNO_3$ per liter, for example) is circulated between the drain tank 77 and the electrolytic cell 60. When the pump 89 is set rotating, the electrolytic solution 11 in the drain tank 77 is advanced through the second pipe 86 and the liquid feed pipe 90 to the electrolytic cell 60, then passed through the overflow pipe 78 of the electrolytic cell, and returned to the drain tank 77. Since the electrolytic cell 60 is provided on the lateral wall thereof with the overflow pipe 78, the level of the electrolytic solution 11 can be kept constant. As the result, the anode 13 and the cathode 14 can be kept immersed in the electrolytic solution and the entire surface areas of the two electrodes 13 and 14 can be effectively utilized. Since the filter is disposed halfway in the length of the liquid feed pipe 90 for the electrolytic cell, the insolubles containing the contaminant separated from the surface of the object 12 are caught by this filter 93. The separated contaminant, therefore, has no possibility of finding its way into the electrolytic cell 60. Moreover, the accumulation of the contaminant in the electrolytic solution can be curbed. The filter 93 which collects the contaminant is covered with the shielding member 96. The shielding member 95 serves the purpose of curbing the exposure of operators to radioactivity. The electrolytic solution 11 is kept at a constant elevated temperature by the heater emitting heat and the temperature sensor 62 monitoring the temperature and, at the same time, voltage is applied between the two electrodes 13 and 14. As the result, the electrolytic solution 11 formed of an aqueous nitric acid solution containing trivalent cerium ions and tetravalent cerium ions undergoes the electrolytic oxidation-reduction reactions represented by the aforementioned formulas (1) through (3) to convert the trivalent cerium ions ($Ce^{3+}$) into tetravalent cerium ions ($Ce^{4+}$).

Then, the object 12 for decontamination is placed in the decontamination cell 68 and the pump 97 is set rotating to circulate the electrolytic solution 11 between the drain tank 77 and the decontamination cell 68. When the pump 97 is operated, the electrolytic solution 11 in the drain tank 77 is advanced through the first pipe 84 and the liquid feed pipe 98 for the decontamination cell into the decontamination cell 68, passed through the overflow pipe 75 of the decontamination cell, and returned to the drain tank 77. Since the decontamination cell 68 is provided on the lateral wall thereof with the overflow pipe 75, the level of the electrolytic solution 11 is kept constant without reference to the size of the object 12. Thus, there is no possibility of the electrolytic solution flowing out of the decontamination cell 68. Since the filter 101 is disposed halfway in the length of the liquid feed pipe 98 for the decontamination cell, the insolubles containing the contaminant separated from the surface of the object 12 are caught by this filter. The accumulation of the contaminant in the electrolytic solution, therefore, can be curbed. The filter 101 which by nature collects the contaminant is covered with the shielding member 104. The shielding member 104, therefore, contributes to curbing the exposure of operators to radiation. In the decontamination cell 68, the electrolytic solution 11 is kept at a constant elevated temperature by the heater emitting heat and the temperature sensor 70 monitoring the temperature. In the decontamination cell 68, therefore, the tetravalent cerium ions formed in the electrolytic cell 60 are converted into trivalent cerium ions and, at the same time, the surface layer of the metallic matrix of the object 12 is dissolved by the oxidizing power generated in consequence of the conversion. Thus, the contaminant on the surface of the object 12 is removed. The reaction in which the tetravalent cerium ions ($Ce^{4+}$) are converted into trivalent cerium ions ($Ce^{3+}$) and, at the same time, the surface layer of the metallic matrix of the object 12 is dissolved proceeds as shown by the aforementioned reaction formula (4).

As is evident from the description given to this point, the dissolution or decontamination of the surface of the object 12 is attained so long as the surface of the object is held in contact with the electrolytic solution 11. The apparatus for decontamination of radioactivated metallic waste in the present embodiment, therefore, enjoys ample adaptability to the complexity of shape of the object as compared with the apparatus for electrolytic decontamination which requires two electrodes to be opposed to the contour of the object. The apparatus of the present embodiment effects the dissolution of the surface of the object 12 by means of the exidative power of tetravalent cerium ions and, therefore, obtains required decontamination quickly. The trivalent cerium ions which are formed in the decontamination cell 68 are converted to tetravalent cerium ions in the electrolytic cell 60. This means that the electrolytic solution is regenerated and put to reuse. This apparatus does not produce any spent electrolytic solution.

When the decontamination of the object is completed, the valve 80 is closed and the electrolytic solution 11 in the decontamination cell 68 is discharged through the drain pipe 79 into the drain tank 77. After the electrolytic solution 11 in the decontamination cell 68 has been wholly discharged into the drain tank 77, the valve 80 is kept closed and the pump 13 is set rotating to transfer the rinse water 128 in the rinse water tank 107 through the rinse water feed pipe 128 into the decontamination cell and wash the decontaminated object 12 and relieve it of the adhering electrolytic solution and, at the same time, wash out the electrolytic solution adhering to the inner wall of the decontamination cell 68. Now, with the valve 105 kept open, the rinse water used in the decontamination cell 68 is returned through the rinse water return pipe 106 to the rinse water tank 107. After the rinsing is over, the lid 71 is removed from the decontamination cell 68 and the object 12 is removed.

During the course of the operation described above, the electrolytic cell 60 is kept closed with the lid 63, the decontamination cell 68 with the lid 71, and the drain tank 77 with the lid 81, and the waste gas treating device 112 is kept in an operable condition. As the result, the interior of the electrolytic cell 60, that of the decontamination cell 68, and that of the drain tank 77 are kept under weak negative pressure. The nitric acid vapor and mist generated in the electrolytic cell 60, the decontamination cell 68, and the drain tank 77 are decontaminated by the nitric acid vapor recovery device 109 and the mist recovery device 110 both of the waste gas treating device 112 and released by the waste gas blower 111 into the ambient air. During the course of the operation of the apparatus, the nitric acid vapor and the radioactive electrolytic solution mist are not suffered to leak from the apparatus and the safety of operators is maintained because the electrolytic cell 60 is kept closed with the lid 63, the decontamination cell 68 with the lid 71, and the drain tank 77 with the lid 81, and the waste gas treating device 112 is kept operating at all times. It is only the lid 71 of the decontamination cell 68 that is opened during the course of the operation. The lid 71 of the decontamination cell 68 is opened, as described above, only when the object 12 is removed from the decontamination cell after the object 12 and the inner wall of the decontamination cell 68 have been rinsed. The safety of the operation is maintained, therefore, because there is no possibility of the operators being exposed to the nitric acid or to the radioactive electrolytic solution.

A typical application of the apparatus of the fourth embodiment of the invention to treatment of an object will be described below.

In the decontamination cell 68, a pipe (2B sch. 40×165 inches) of stainless steel (AISI 304) was immersed as the object 12. The $Ce^{4+}$ concentration in the electrolytic solution 11 was 0.4 mol/liter. When the decontamination was continued for one hour, the results were as shown in Table 2. Table 2 shows the data which represent the results of decontamination obtained at varying temperatures. It is noted from the table that no effective decontamination was observed when the temperature of the electrolytic solution was 30° C. and effective decontamination to the background level was observed when the temperature was 80° C. The thickness of abrasion represents the amount of decontamination calculated from the loss of weight, the intensity of α-ray represents the amount of surface contamination of the object, and the speed of decontamination represents the amount of surface contamination of the object removed per second.

TABLE 2

| | Decontamination of pipe of stainless steel | | | |
|---|---|---|---|---|
| | Thickness | Intensity of α-ray | | Speed of |
| Temperature (°C.) | of abrasion (μ) | Before decontamination | After decontamination | decontamination (cpm/sec) |
| 30 | 2 | 635,000 | 354,000 | 78.1 |
| 50 | 10 | 647,000 | 168,000 | 133 |
| 80 | 45 | 626,000 | 49,000 | 160 |

note; Background level, 250 cpm.

The effects brought about by the fourth embodiment of the present invention are as follows.

(1) The apparatus effectively decontaminates a given object by keeping its surface in contact with the electrolytic solution and, therefore, ensures high adaptability to the complexity of shape of the object.

(2) The decontamination proceeds at a high speed because the surface of the object is dissolved by utilizing the oxidative power generated when tetravalent cerium ions are converted into trivalent cerium ions.

(3) Since the electrolytic cell is provided on the lateral side thereof with the overflow pipe, the level of the electrolytic solution therein is kept constant and the entire surface areas of the electrodes are effectively utilized.

(4) Since the decontamination cell is provided on the lateral side thereof with the overflow pipe, the level of the electrolytic solution therein is kept constant without reference to the size of the object and there is no possibility of the electrolytic solution spilling from the decontamination cell.

(5) Since the filter disposed halfway in the liquid feed pipe extended from the drain pipe to the electrolytic cell is covered with the shielding member, the electrolytic cell has no possibility of admitting any contaminant and the electrolytic solution is prevented from accumulation of contaminant and the exposure of operators to radiation is reduced.

(6) Since the electrolytic cell, the decontamination cell, and the drain tank are kept closed with their respective lids and the waste gas treating device is operated constantly during the course of the operation, the nitric acid vapor and the radioactive electrolytic solution mist are not suffered to leak from the apparatus and the safety of operators can be maintained.

(7) Since the lid of the decontamination cell is removed and the object is taken out of the decontamination cell only after the object and the inner wall of the decontamination cell have been rinsed, the operators of the apparatus have no possibility of exposing themselves to nitric acid or radioactive electrolytic solution and enjoy safety.

Figure 13:
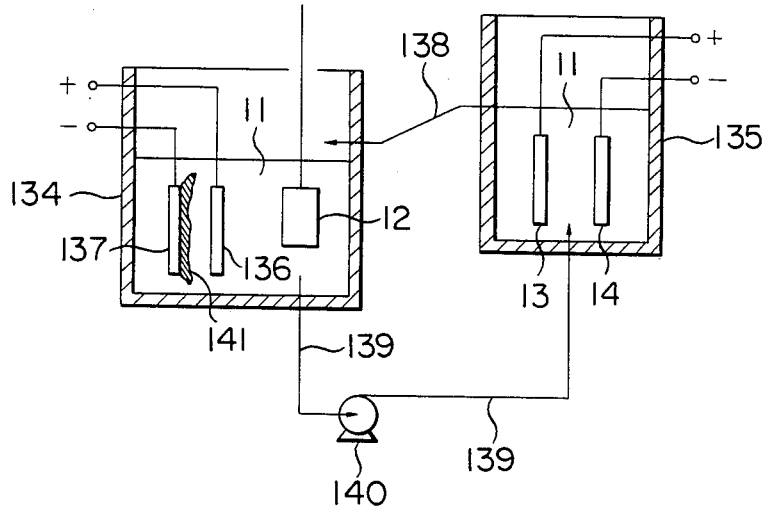
FIG. 13 is a longitudinal cross section illustrating, schematically in part, the fifth embodiment of the present invention.

Now, the fifth embodiment of the present invention will be described below with reference to FIG. 13. In FIG. 13, the symbol 134 denotes a metal-separating decontamination cell. This metal-separating decontamination cell 134 contains the electrolytic solution 11 formed of an aqueous nitric acid solution containing trivalent cerium ions and tetravalent cerium ions. In this electrolytic solution 11 are immersed, as mutually opposed, a metal-precipitating anode 136 of inactive metal and a metal-precipitating cathode 137 of a metallic material having hydrogen overvoltage of a large absolute value. Plus voltage is applied to the metal-precipitating anode 136 and minus voltage to the metal-precipitating cathode 137. The aforementioned metal-separating decontamination cell 134 serves concurrently to dissolve the surface of the radioactive metallic waste or the object 12 for decontamination and remove the radioactive substance from the surface of the object. In the electrolytic solution 11, the object 12 is kept immersed.

The symbol 135 in FIG. 13 denotes a cerium regeneration cell. This cerium regeneration cell 135 contains the same electrolytic solution 11 as contained in the aforementioned metal-separating decontamination cell 134, i.e. an aqueous nitric acid solution containing trivalent cerium ions and tetravalent cerium ions. In the electrolytic solution 11, a cerium-regnerating anode 13 having plus voltage applied thereto and a cerium-regenerating cathode 14 having plus voltage applied thereto are immersed as opposed to each other. The cerium-regneration cell 135 and the metal-separating decontamination cell 134 are connected to each other through the medium of circulation pipes 138 and 139. Halfway in the length of the circulation pipe 139 is disposed a circulation pump 140. The electrolytic solution 11, therefore, is circulated between the metal-separating decontamination cell 134 and the cerium-regeneration cell 135.

Now, the operation of the apparatus according with the fifth embodiment described above will be explained.

In the cerium-regeneration cell 135, the electrolytic solution 11 formed of an aqueous nitric acid solution containing trivalent cerium ions and tetravalent cerium ions induces conversion of trivalent cerium ions ($Ce^{3+}$) into tetravalent cerium ions ($Ce^{4+}$) under the influence of the electrolytic oxidation-reduction reactions represented by the aforementioned reaction formulas (1) through (3). The electrolytic solution 11 in which the tetravalent cerium ion ($Ce^{4+}$) concentration has been increased is transferred through the circulation pipe 138 to the metal-separating decontamination cell 134. In this metal-separating decontamination cell 134, the tetravalent cerium ions formed in the cerium-regneration cell 135 are converted into trivalent cerium ions and, at the same time, the surface layer of the metallic matrix of the object 12 is dissolved and the radioactive contaminant on the surface of the object 12 is consequently removed by the oxidizing power generated in consequence of the aforementioned conversion. The reaction in which the tetravalent cerium ions ($Ce^{4+}$) are converted into trivalent cerium ions ($Ce^{3+}$) and, at the same time, the surface layer of the metallic matrix of the object 12 is dissolved proceeds as represented by the aforementioned reaction formula (4).

About 90% of the radioactivity which migrates into the electrolytic solution as a consequence of the dissolution of the surface layer of the metallic matrix of the object 12 is present in the insolubles and, therefore, can be easily separated from the electrolytic solution 11 by means of a filter, for example. The remainder, about 10%, of the radioactivity is present as metallic ions dissolved in the electrolytic solution 11. In the conventional decontamination apparatus, these radioactive metallic ions are accumulated in the electrolytic solution 11 in conjunction with metallic ions which are free from radioactivity.

In the apparatus of FIG. 13, however, the electrolytic reaction induced by the voltage applied between the anode 136 and the cathode 137 causes the metallic ions in the electrolytic solution 11 to deposit in the form of a precipitate 141 on the surface of the cathode 137. By separating this precipitate 141, therefore, the accumulation of radioactivity and the metallic ions in the electrolytic solution 11 can be repressed. Even when the metallic ions are deposited as the precipitate 14 on the surface of the cathode 137 and they are, consequently, easily separated from the electrolytic solution 11, the accumulation of such metallic ions in the electrolytic solution cannot be curbed if metallic ions are dissolved out of the anode 136. It is therefore, imperative that the anode 136 should be made of an inactive metal, i.e. a metal which is not dissolved by anodic electrolysis. Examples of the inactive metal are titanium, platinum, titanium coated with platinum, and other metals other than titanium coated with platinum. In the present embodiment, since the anode 136 is made of an inactive metal, no metallic ion is dissolved out of the anode 136. Unlike the conventional apparatus using a carbon electrode, the apparatus of the present embodiment does not entail complete dissolution of the component of the electrode. On the surface of the cathode 137, the reaction of metal precipitation and the reaction of hydrogen formation compete with each other. When the cathode 137 is made of such a metallic material as platinum, iron, or nickel which has hydrogen overvoltage of a low value, the proportion of the electric current which is used in the formation of hydrogen is larger than that used for the precipitation of metal, the current efficiency with respect to the metal precipitation is degraded. It is, therefore, imperative that the cathode 137 should be made of a metallic material incapable of easily inducing formation of hydrogen, i.e. a metallic material having hydrogen overvoltage of a high value. The metallic materials, in the increasing order of hydrogen overvoltage, are platinum black, rhodium, gold, tungsten, smooth platinum, nickel, molybdenum, iron, silver, aluminum, beryllium, niobium, tantalum, copper, graphite, bismuth, lead, tin, indium, thalium, mercury, and cadmium. For the current efficiency with respect to metal precipitation to be improved over that which is obtained by using stainless steel or ordinary steel as in the conventional apparatus, it is necessary that the cathode 137 should be made of a metallic material whose absolute value of hydrogen overvoltage is larger than the absolute value of the hydrogen overvoltage of iron.

Table 3 compares the results of the determination of current efficiency regarding metal precipitation obtained in the apparatus of the fifth embodiment and the conventional apparatus.

As the electrolytic solution, a solution obtained by causing the aforementioned electrolytic oxidation-reduction reactions on an aqueous solution having a $Ce(NO_3)_3$ concentration of 0.8 mol/liter and a $HNO_3$ concentration of 2 mol/liter thereby inducing formation of tetravalent cerium ions ($Ce^{4+}$) and effecting dissolution of 100 g of stainless steel per liter was used. The temperature of the electrolytic solution was fixed at 80° C. The cathode in the apparatus of the embodiment was made of lead and that in the conventional apparatus stainless steel. The anode in either of the apparatuses was made of titanium coated with platinum. The current efficiency regarding metal precipitation was determined by the amount of stainless steel dissolved out as iron, Fe, in accordance with the following formula.

(Current efficiency) = (Weight of Fe precipitated)/(Weight of Fe calculated on assumption that the whole amount of electric current passed is consumed in the precipitation of Fe in accordance with Faraday's law)

$$= (\text{Weight of Fe recovered})/(M \times I \times (60 \times t)/(Z \times F))$$

wherein

M: Molecular weight of Fe, 56 (−)
I: Electric current, 2 (A)
t: Actually found time of passage of current (min.)
Z: Valency, 2 (−)
F: Faraday constant, 96,500 (C/mol)

TABLE 3

| Material of cathode | Current efficiency regarding metal precipitation (%) |
|---|---|
| Lead (embodiment of this invention) | 80 |
| Stainless steel (conventional) | 40 |

It is noted from Table 3 that the apparatus of the present embodiment has about twice as high current efficiency regarding metal precipitation as the conventional apparatus. This is because the cathode made of a metallic material having high hydrogen overvoltage renders formation of hydrogen difficult and increases the proportion of electric current consumed in metal precipitation as compared with that of electric current consumed in formation of hydrogen.

Since the cathode 137 is made of a metallic material having high hydrogen overvoltage, the proportion of electric current consumed in th precipitation of metal becomes larger than that consumed in the formation of hydrogben and the metal component dissolved out into the electrolytic solution is consequently allowed to be separated with increased efficiency. As the result, the radioactivity already transformed into dissolved metallic ions which defy separation by a filter are allowed to deposit on the cathode and, therefore, are separated efficiently. Thus, the radioactivity dissolved in the electrolytic solution is prevented from growing in quantity.

Since the precipitate 141 adheres loosely to the cathode 137, it can be easily separated. The precipitate 141 separated from the cathode 137 is discarded as radioactive waste. Now, the fifth embodiment described above and the conventional apparatus which entails discharge of spent electrolytic solution as waste will be compared below in terms of the amount of secondary waste produced in consequence of decontamination. The amount is reported by the amount of metallic ions, $Fe^{3+}$, contained in the electrolytic solution. The amount of the secondary waste, namely, the electrolytic solution containing 1 kg of $Fe^{3+}$, is considered specifically. In contrast, in the apparatus of the fifth embodiment, the secondary waste is the separated precipitate, Fe. Since cerium is expensive, the electrolytic solution ready to be discarded may be subjected to an extra treatment for the recovery of cerium. Even so, the electrolytic solution contains $NO_3-$ in an amount at least equivalent to the amount of $Fe^{3+}$and, therefore, must be neutralized to ensure safe disposal. This neutralization proceeds as represented by the following formula.

$$Fe^{3+} + 3(OH) \longrightarrow Fe(OH)_3$$

$$3NO_3^- + 3Na \rightarrow 3NaNO_3$$

When the spent electrolytic solution so neutralized and consequently containing $Fe(OH)_3$ and $NaNO_3$ is concentrated and dried, the $Fe(OH)_3$ converts into $Fe_2O_3$ powder incorporating the water of crystallization an the $NaNO_3$ into crystalline powder of $NaNO_3$. The amount of the $Fe_2O_3$ powder disregarding the water of crystallization and the amount of the $NaNO_3$ powder calculated based on 1 kg of Fe are as shown below.

(Amount of $Fe_2O_3$ powder produced = (1 kg) × (molecular weight of $Fe_2O_3$)/2/(molecular weight of Fe)

$$= 160/2/56 = 1.4 \text{ kg}$$

(Amount of $NaNO_3$ powder produced) = (1 kg) × (molecular weight of $NaNO_3$) × 3/(molecular weight of Fe)

$$= 85 \times 3/56 = 4.6 \text{ kg}$$

Table 4 compares the results of calculation of the amount of secondary waste based on 1 kg of Fe as produced in the apparatus of the fifth embodiment of this invention and in the conventional apparatus entailing discharge of the spent electrolytic solution.

TABLE 4

| | Apparatus of fifth embodiment | Conventional apparatus entailing release of spent electrolytic solution | |
|---|---|---|---|
| Secondary waste | Fe alone, 1 kg | $Fe_2O_3$ powder | 1.4 kg |
| | | $NaNO_3$ powder | 4.6 kg |
| Total | 1 kg | 6 kg | |

Table 4 shows that when 1 kg of the metal of the object is dissolved, the amount of secondary waste produced is 1 kg in the case of the fifth embodiment and 6 kg in the case of the conventional apparatus which entails release of spent electrolytic solution. This means that the present embodiment reduces the amount of secondary waste produced in consequence of decontamination of about 1/6 of the amount produced from the conventional apparatus involving the release of the spent electrolytic solution.

Evidently, the fifth embodiment of this invention separates the metallic ions in the electrolytic solution in the form of metal and discharges the separated metal as the sole radioactive waste. Thus, it ensures a marked decrease in the amount of secondary waste as compared with the operation which releases the spent electrolytic solution as the waste.

What is claimed is:

1. An apparatus for the decontamination of a metallic object contaminated by radiation, comprising:

an electrolytic cell containing an electrolytic solution formed of an aqueous cerium nitrate solution containing trivalent cerium ions and tetravelent cerium ions, an anode and a cathode immersed in said electrolytic solution in said electrolytic cell and connected to a direct current power source, a feed pipe connected to a lateral side of said electrolytic cell and including a liquid pump, a decontamination cell connected to said feed pipe through said liquid pump, said decontamination cell containing said radiation-contaminated metallic object, a drain line connected from a lower section of said decomtamination cell to said electrolytic cell, said drain line including a filter and a circulation pump, a waste gas pipe connected to upper sections of said electrolytic cell and said decontamination cell to remove gases from said cells, a condenser connected to said waste gas pipe to liquefy said gases removed from said cells, a return pipe connected from said condenser to said electrolytic cell to return said liquefied gases to said electrolytic cells, a gas outlet pipe for leading out waste gas emanating from said condenser, and a demister and a waste gas blower connected to said gas outlet and adapted to recover water-nitric acid vapor and mist from said waste gas.

2. An apparatus according to claim 1, wherein said electrolytic cell is provided with a heater for heating said electrolytic solution.

3. An apparatus according to claim 1, wherein a branched pipe is disposed on the downstream side of said feed pipe, wherein a leading end of said branched pipe and a leading end of said feed pipe are connected to annular pipes disposed inside said decontamination cell.

4. An apparatus according to claim 3, wherein said annular pipes are disposed stepwise within said decontamination cell and slanted nozzles are connected one each to said annular pipes.

5. An apparatus according to claim 1, wherein a performated plate containing a through hole at the center thereof is disposed, through a support valve, in the lower section of said decontamination cell.

6. An apparatus for the decontamination of a metallic object contaminated by radiation, comprising:

an electrolytic cell containing an electrolytic solution formed of an aqueous cerium nitrate solution formed of trivalent cerium ions and tetravalent cerium ions, an anode and a cathode immersed in said electrolytic solution and connected to a direct current power source, a drain tank connected to said electrolytic cell through an overflow pipe, a first pipe connected through a valve to said drain tank, a decontamination cell holding said radiation-contaminated metallic object, a feed pipe connected to said decontamination cell through a liquid pipe and connected to said first pipe through a first pump, a rinse water tank connected through a rinse water return pipe to a lower section of said decontamination cell, a second pump connected through a pump to a lower section of said rinse water tank and through a third pipe to said drain tank, said liquid pipe being connected through a feed pipe for electrolysis to said pump and to said electrolytic cell, waste gas pipes connected one each to upper sections of said electrolytic cell, said decontamination cell, and said drain tank, a waste gas duct for collectively leading out waste gas from said waste gas pipes, a nitric acid vapor recovery device connected to said waste gas duct, a receptacle connected to said nitric acid vapor recovery device, a mist recovery device connected through a waste gas pipe to the empty space in an upper section of said receptacle, a waste gas blower connected through a waste gas pipe to said mist recovery device, and a recovery return pipe connected from the lower section of said receptacle to said drain tank.

7. An apparatus according to claim 6, wherein a filter is disposed between said feed pipe for electrolysis and said liquid pipe and said filter is enclosed with a radiation shielding member.

8. An apparatus according to claim 6, wherein a filter is disposed between said feed pipe for decontamination and said liquid pipe and said filter is enclosed with a radiation shielding member.

9. An apparatus according to claim 6, wherein said electrolytic cell and said decontamination cell are each provided with a heater for heating said electrolytic solution.

10. An apparatus according to claim 6, wherein a feedback pipe for spraying is connected through a pipe to said mist recovery device and a spray nozzle is connected to said feedback pipe so as to effect spraying of a second filter within said recovery device.

11. An apparatus according to claim 7 or claim 9, wherein pressure gauges are incorporated one each in pipes on the upstream side and downstream side of said filter.

12. An apparatus for the decontamination of a metallic object contaminated by radiation, comprising:

an electrolytic solution cell holding an electrolytic solution formed of an aqueous cerium nitrite solution containing trivalent cerium ions and tetravalent cerium ions, said electrolytic solution cell including first and second cell sections;

an anode and a cathode immersed in said electrolytic solution and connected to a direct current power source, said anode and cathode being contained in said first electrolytic cell section;

a contaminated metallic object holder for holding a radiation-contaminated metallic object immersed in said electrolytic solution, said object holder being contained in said second electrolytic cell section;

a circulation pipe connected between said first cell section and said second cell section of said electrolytic solution cell for allowing said electrolytic solution in circulate; and a filter and a circulation pump coupled to said circulation pipe to cause said electrolytic solution to circulate in said pipe.

13. An apparatus according to claim 12, wherein said first cell section and said second cell section each have a sealed empty space in the upper portion thereof connected to a condenser, a demister and a waste gas blower through a waste gas pipe means.

* * * * *